US010081470B2

(12) United States Patent
Weaver et al.

(10) Patent No.: US 10,081,470 B2
(45) Date of Patent: Sep. 25, 2018

(54) RECLOSABLE PACKING CASE AND METHOD OF MAKING SAME

(71) Applicants: J. Michael Weaver, Madison, CT (US); Jeffrey Reilly, Killingworth, CT (US)

(72) Inventors: J. Michael Weaver, Madison, CT (US); Jeffrey Reilly, Killingworth, CT (US)

(73) Assignee: STANDARD KNAPP INC., Portland, CT (US)

( * ) Notice: Subject to any disclaimer, the term of this patent is extended or adjusted under 35 U.S.C. 154(b) by 21 days.

(21) Appl. No.: 15/270,345

(22) Filed: Sep. 20, 2016

(65) Prior Publication Data

US 2017/0008682 A1 Jan. 12, 2017

Related U.S. Application Data

(63) Continuation of application No. 13/826,004, filed on Mar. 14, 2013, now abandoned.

(51) Int. Cl.
*B65D 71/12* (2006.01)
*B65D 71/38* (2006.01)
(Continued)

(52) U.S. Cl.
CPC ..... *B65D 71/36* (2013.01); *B65B 7/20* (2013.01); *B65B 21/242* (2013.01); *B65D 5/18* (2013.01);
(Continued)

(58) Field of Classification Search
CPC ..... B65D 71/125; B65D 71/38
(Continued)

(56) References Cited

U.S. PATENT DOCUMENTS 2,082,677 A 6/1937 Belsinger
2,124,409 A 7/1938 Andrews
(Continued)

FOREIGN PATENT DOCUMENTS

CA 922280 A 3/1973
DE 29501690 U1 3/1995
(Continued)

OTHER PUBLICATIONS

Extended European Search Report and Written Opinion for EP Patent Application No. 15190019.8, dated Jan. 20, 2016, pp. 1-10.
(Continued)

*Primary Examiner* — Christopher Demeree
(74) *Attorney, Agent, or Firm* — Cantor Colburn LLP

(57) ABSTRACT

A wraparound case includes a first blank component having no more than three panels including a closure panel, a first side panel and a second side panel and a second blank component includes a base panel portion having a first edge portion and a second edge portion, a third side panel, a fourth side panel, a first flap extending from the third side panel and a second flap extending from the fourth side panel. The first blank component and the second blank component are directly wrapable about a load with the third side panel being joinable to the first and second side panels and the first edge of the closure panel and the fourth side panel being joinable to the first and second side panels and the second edge of the closure panel. The first flap, the second flap and the base panel portion forming exactly one reclosable face.

11 Claims, 3 Drawing Sheets

(51) Int. Cl.

| | |
|---|---|
| ***B65D 71/36*** | (2006.01) |
| ***B65B 7/20*** | (2006.01) |
| ***B65B 21/24*** | (2006.01) |
| ***B65D 5/18*** | (2006.01) |

(52) U.S. Cl.
CPC ..... *B65D 71/38* (2013.01); *B65D 2571/0066* (2013.01); *B65D 2571/0079* (2013.01); *B65D 2571/00141* (2013.01); *B65D 2571/00154* (2013.01); *B65D 2571/00234* (2013.01); *B65D 2571/00561* (2013.01); *B65D 2571/00666* (2013.01)

(58) Field of Classification Search
USPC ..... 229/122.23, 122.24, 103.2, 122.21, 229/122.32; 206/155; 220/23.91, 220/DIG. 25; 53/461
See application file for complete search history.

(56) References Cited

U.S. PATENT DOCUMENTS

| | | | | |
|---|---|---|---|---|
| 3,246,744 | A | 4/1966 | Marnon | |
| 3,434,648 | A * | 3/1969 | Du, Jr. ..... | B65D 5/323 229/122.26 |
| 3,744,700 | A | 7/1973 | Stegmann | |
| 3,817,018 | A | 6/1974 | Vickers | |
| 3,910,483 | A | 10/1975 | Ritter | |
| 4,133,474 | A | 1/1979 | Hall | |
| 4,275,828 | A | 6/1981 | De Franco | |
| 4,471,870 | A * | 9/1984 | Uhlig ..... | B65D 71/38 206/150 |
| 4,871,067 | A | 10/1989 | Valenti | |
| 5,495,943 | A | 3/1996 | Bienaime | |
| 6,283,363 | B1 | 9/2001 | Focke | |
| 7,066,379 | B2 | 6/2006 | McLeod et al. | |
| 7,837,089 | B2 | 11/2010 | Pacheco | |
| 2006/0272961 | A1 | 12/2006 | Justice et al. | |
| 2008/0257942 | A1 | 10/2008 | Lebras | |
| 2010/0314436 | A1 * | 12/2010 | Tao ..... | B65D 5/324 229/122.24 |
| 2011/0049226 | A1 | 3/2011 | Moreau et al. | |
| 2014/0260106 | A1 | 9/2014 | Weaver et al. | |

FOREIGN PATENT DOCUMENTS

| | | | |
|---|---|---|---|
| EP | 0409366 | A2 | 1/1991 |
| GB | 547523 | A | 9/1942 |
| GB | 929805 | A | 6/1963 |
| JP | 2005219792 | A | 8/2005 |

OTHER PUBLICATIONS

International Preliminary Report of Patentability for PCT Application No. PCT/US2014/021829, dated Sep. 15, 2015, pp. 1-10.
International Search Report and Written Opinion for PCT Application No. PCT/US2014/021829, dated Jun. 20, 2014, pp. 1-14.
Extended Search Report and Written Opinion dated Dec. 9, 2016 in related EP Patent Application No. 14772945, 8 pages.

* cited by examiner

RECLOSABLE PACKING CASE AND METHOD OF MAKING SAME

CROSS-REFERENCE TO RELATED APPLICATIONS

The present application is a continuation of U.S. application Ser. No. 13/826,004 filed on Mar. 14, 2013, the contents of which are incorporated by reference herein in their entirety.

BACKGROUND

Various boxes, packages, packing cases, and other containers are known and used in various arts, e.g., for packaging, transportation, and storage. Examples include bliss boxes, regular slotted containers (RSCs), triple slide boxes, wrap-around boxes, recessed end boxes, and others. Boxes are most commonly made from corrugated fiberboard or cardboard sheets for a variety of reasons such as good strength, low cost, and low weight.

RSCs are prevalent in many industries, such as the wine and spirit packaging industry, and favored, particularly in the United States but in other countries as well, due to their ability to maintain stacking strength and the ability to reclose after opening. This enables RSCs to be reused for other purposes after opening. It also enables the contents of an RSC to be only partially removed, e.g., one or more selected items removed from the RSC without compromising the ability of the RSC to be reclosed and restacked. Bliss boxes generally provide similar benefits as RSCs, in addition to increased stacking strength. RSCs and bliss boxes are first assembled and then loaded with a product or products and closed for transport. Oppositely, wrap-around style boxes are formed by directly wrapping and closing a blank about a load. This provides a notable material savings over RSCs and bliss boxes and additional cost savings due to increased manufacturing speed. Opening a wrap-around box, however, results in a significant loss of structural integrity to the box. Boxes made from wrap-around blanks also cannot be reclosed without the use of adhesives, tape, fasteners, etc., and are thus essentially destroyed or rendered useless after opening. Due to the various trade-offs in cost, manufacturing speed, reusability, strength, etc., many industries would well receive new and alternate package designs.

SUMMARY

A wraparound case includes a first blank component having no more than three panels defining a closure panel including a first side section, a second, opposing side section, a first edge and a second edge, a first side panel extending from the first side section and a second side panel extending from the first side section. The closure panel includes a feature extending between the first and second edges. The closure panel is selectively separable at the feature. A second blank component includes a base panel portion having a first side portion, an opposing second side portion, a first edge portion and a second edge portion, a third side panel extending from the first side portion, a fourth side panel extending from the second side portion, a first flap extending from the third side panel and a second flap extending from the fourth side panel. The first blank component and the second blank component are directly wrapable about a load with the third side panel being joinable to the first and second side panels and the first edge of the closure panel and the fourth side panel being joinable to the first and second side panels and the second edge of the closure panel. The first flap, the second flap and the base panel portion forming exactly one reclosable face of the wraparound case.

A method of forming a packing case, including wrapping a blank directly about a load, the blank having a plurality of panels; forming a packing case containing the load from the blank, the packing case having exactly one reclosable face.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

At the outset it is to be appreciated that any mention of the terms top, bottom, side, left, right, width, height, length, or others indicating some orientation or direction are utilized for the sake of discussion only. These terms may be used to assist in describing an illustrated embodiment or some other particularly described embodiment, are not to be considered limiting to any of the claimed embodiments.

Figure 1:
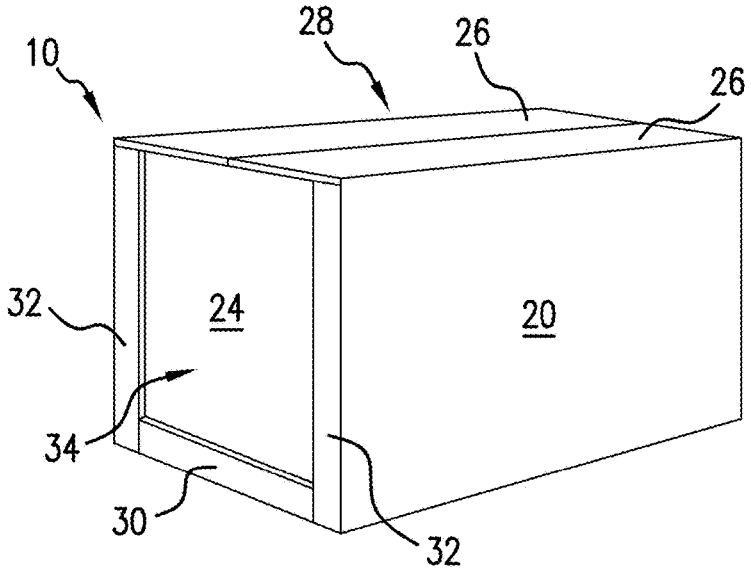
FIG. 1 is a perspective view of a packing case according to one embodiment disclosed herein.
Figure 2:
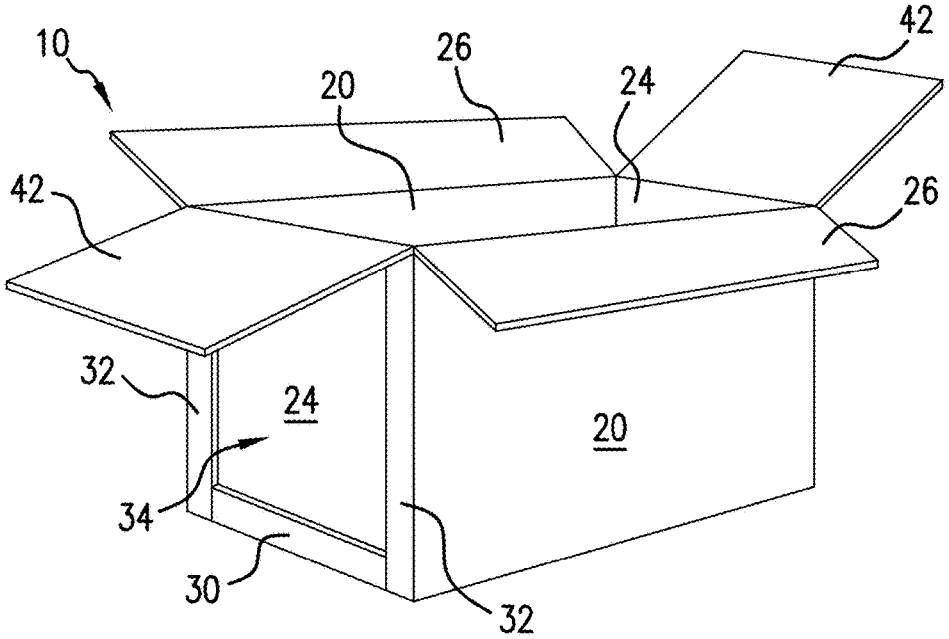
FIG. 2 is a perspective view of the packing case of FIG. 1 in an open configuration.

Referring now to FIGS. 1 and 2, a packing case 10 is shown according to one embodiment in a closed and an open configuration, respectively. The packing case 10 may also be referred to as a box, container, carton, or package, among other synonymous terms. Advantageously, as discussed in more detail below, the case 10 is arranged to combine the benefits of a regular slotted container (RSC) or bliss box (e.g., stacking strength, reclosability, etc.) with that of a wrap-around box (e.g., fast manufacturing speed, low cost, low waste, etc.) without the associated disadvantages of any of those boxes.

Figure 3:
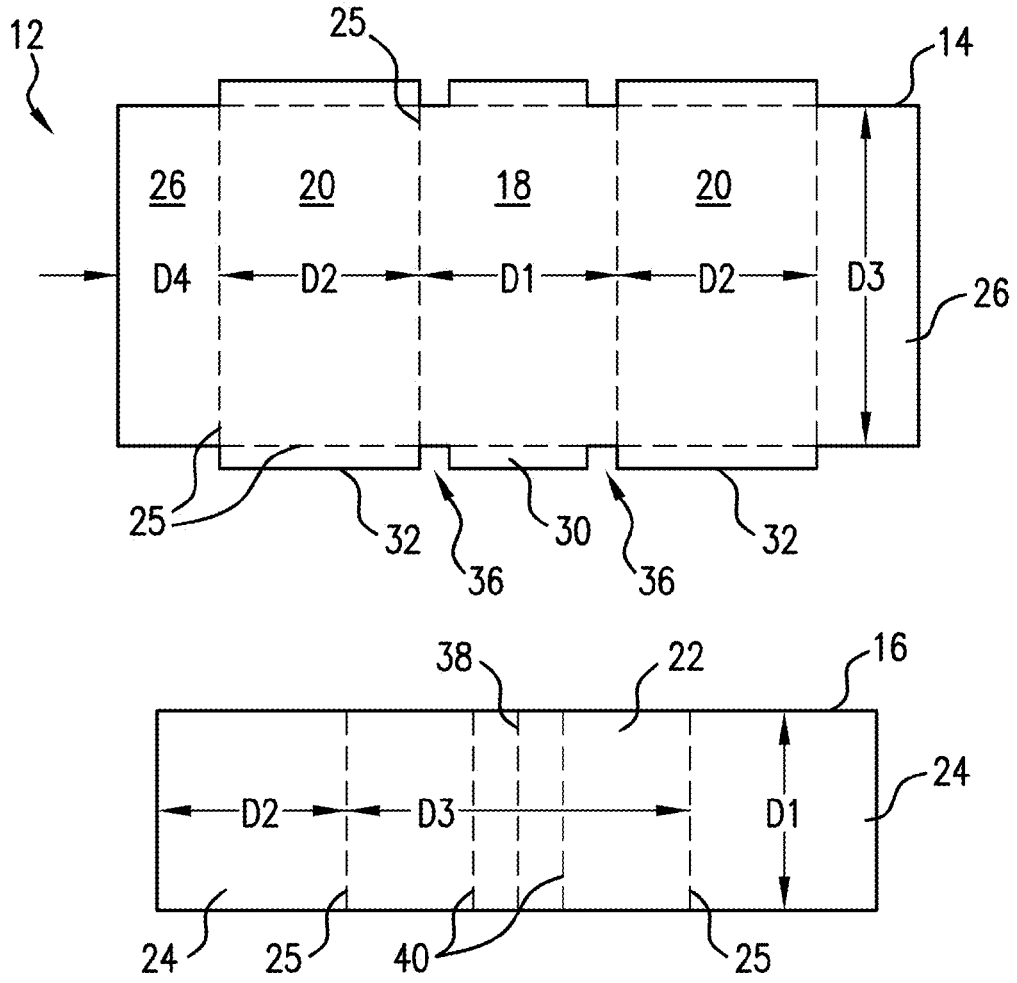
FIG. 3 is a plan view of a two-part blank for making the packing case of FIG. 1.

FIG. 3 illustrates a blank 12 utilized for forming the case 10. The blank 12 includes a first blank component 14 and a second blank component 16 that are affixed together to ultimately form the case 10. The first blank component 14 includes a panel 18 bounded on opposite sides by a pair of panels 20, while the second blank component 16 has a panel 22 bounded on opposite sides by a pair of panels 24. The panels 18 and 22 are hingedly secured to the panels 20 and 24, respectively. The hinged connections are represented by straight dashed lines throughout the drawings, some of which are indicated with the numeral 25. The hinged connections 25 may be pre-formed, e.g., by crushing, compressing, weakening, or otherwise scoring the blank 12 along the desired lines between the panels or may simply form as a result of bending the portions of the blank 12 with respect to each other.

In the illustrated embodiment, a flap 26 is secured to each of the panels 20 opposite from the connection of the panels 20 with the panel 18. In the illustrated embodiment, the flaps 26 at least partially form or define an openable face 28 for the case 10. As will be appreciated in view of the below disclosure, the openable face 28 is also reclosable, such that the case 10 is reusable after opening.

The blank component 14 includes a set of tabs 30 that are hingedly connected (via the connections 25) to the panel 18 at the edges of the panel 18 that are not connected to the panels 20, and a set of tabs 32 that are hingedly connected to the panels 20 at the edges of the panels 20 that are not connected to the flaps 26 or the panel 18. By folding the panels 18, 20, and 22, flaps 26, and tabs 30 and 32 at the hinged connections 25 (dashed lines in FIG. 3), the hinged connections 25 become, form, or otherwise define the edges between the faces of the case 10.

With respect to the orientation of the embodiment illustrated in FIG. 1, the panel 18 forms a bottom face, the panels 20 form a first pair opposing side faces, the panels 24 form a remaining pair of opposing side faces. The panel 22 is located at or along a top face of the case 10, and may optionally at least partially define the openable face 28, which in the illustrated embodiment is a top face. Of course, one will readily recognize that the case 10 or the panels thereof can be reoriented to associate with other faces or directions than that of the illustrated embodiment, and that, e.g., the openable face 28 could be a bottom face or a side face as opposed to a top face, etc.

A set of dimensions D1, D2, D3, and D4 for the blank 12 are denoted in FIG. 3. In one embodiment, a dimension D1 corresponds to the width of the box, a dimension D2 corresponds to the height of the box, and a dimension D3 corresponds to the length of the box, although other designations could be used in non-illustrated embodiments. In the illustrated embodiment, the panels 18 and 22 have dimensions D1×D3, the panels 20 have dimensions D2×D3, the panels 24 have dimensions D1×D2, and the flaps 26 have dimensions D4×D1. The dimensions D1, D2, and D3 could all be the same or different values. In one embodiment, the dimension D4 is equal to about ½(D1), such that the flaps 26 meet in the middle of the openable face 28. In another embodiment, there is included only one of the flaps 26, and the dimension D4 about equals the dimension D1. In one embodiment, D4+D4<D1, such that the flaps 26 do not meet and there is a gap therebetween on the openable face 28, or D4+D4>D1, such that flaps 26 overlap each other. In one embodiment, the flaps 26 have different dimensions, the sum of which is less than, greater than, or about equal to that of the dimension D1.

Figure 4:
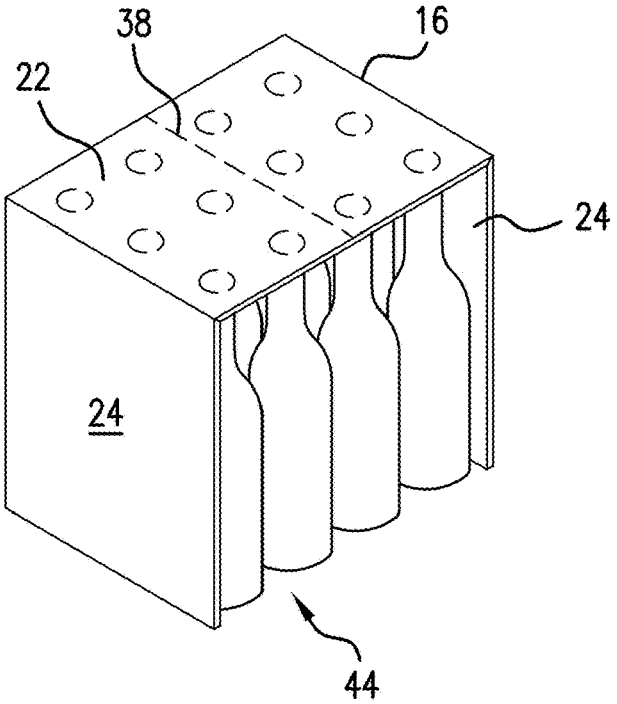
FIG. 4 is a perspective view of a first blank component of the blank of FIG. 3 being directly wrapped about a load.

A face 34 of the case 10 is shown in FIGS. 1 and 4, in which the blank components 14 and 16 are secured together via the tabs 30 and 32. The tabs 30 and 32 are intended to create an overlap between the blank components 14 and 16 in order to enable the blank components 14 and 16 to be secured together. The tabs 30 and 32 of the blank component 14 could be secured to the blank component 16 via any suitable means, such as adhesive tape, glue, or other adhesives, staples or other fasteners, etc.

As shown in FIG. 3, the tabs 30 are spaced from each of the corresponding ones of the tabs 32 via a notch 36. As can be appreciated in view of FIGS. 1 and 4, the notches 36 enable the tabs 30 and 32 to matingly engage against the panel 24 without overlapping each other. In order to accommodate the presence of the notches 36, in the illustrated embodiment the tabs 30 are shorter than the dimension D1 of the panel 18 to which the tabs 30 are attached, enabling the tabs 32 to be essentially the same length as the dimension D2 of the panel 20 to which the tabs 32 are attached. It is of course to be appreciated that the tabs 30 and 32 could take other lengths relative to the panels to which they are secured and that the notches 36 could be formed such that the tabs 32 are relatively shortened. It is also to be appreciated that the notches 36 do not need to be rectangular, but could instead be formed at some angle, e.g., 45 degrees. It is also to be appreciated that some or all of the tabs 30 and 32 could be hingedly connected to the blank component 16 and used to secure the blank component 16 to the blank component 14 by overlapping portions of the panels 18 and 20. It is also to be appreciated that the tabs 30 and 32 could be located on the inner surface of the panels 24, such that they cannot be seen when the case 10 is viewed from the outside, with the face 34 presented by one of the panels 24 as a flat surface. Regardless of whether the tabs 30 and 32 are engaged with the inner or outer surfaces of the panels 24, the dimensions of the face 34 are defined or set by the dimensions of the panels 24.

Regardless of orientation, the case 10 has one face intended to be opened, i.e., the openable face 28, with the remaining five faces being unopenable or intended to remain closed and undamaged during opening the case 10. By unopenable and/or closed and undamaged during opening the case 10 it is meant that the structural integrity of the case 10 in general, or any of the unopenable faces specifically, is not compromised by the opening process. More specifically, the structural integrity is not compromised if none of the unopenable faces or the hinged connections associated with the panels of the unopenable faces are split, cut, severed, unattached, disassembled, or otherwise broken in order to open the case 10. In other words, only the panels and/or flaps forming the openable face 28 are interacted with, destroyed, damaged, or modified in order to open the case 10. In one embodiment, a strip of tape or packing adhesive is applied along the seam formed where the flaps 26 meet on the openable face 28, and the case 10 is opened by cutting, splitting, breaking, severing, or removing the tape (the five unopenable faces, and all hinged connections associated therewith, are thereby unaffected by the opening of the case 10 and the structural integrity of the case 10 is uncompromised).

It is to be further appreciated that advantageously each of the five unopenable faces is formed by essentially a single one of the panels 18, 20, or 24. That is, each of the five unopenable faces shares the dimensions of a single one of the panels 18, 20, or 24. Alternatively stated, the dimensions of each of the unopenable faces of the case 10 is defined by a single one of the panels 18, 20, or 24. For example, the dimensions of the faces of the box in the illustrated embodiment will be shared and/or defined by the dimensions D1, D2, and D3 of the panels 18, 20, and 24 discussed above. This differs, for example, from traditional wraparound boxes, which have at least one pair of side panels that are formed from multiple flaps or panels, which generally meet at a seam down the middle of the face. The face 34, discussed above, includes the tabs 30 and 32, but these tabs overlap the panel 24 such that the face 34 is still defined by the panel 24 and shares the dimensions of the panel 24. Similarly, the bottom face of an RSC is formed by two to four flaps that generally meet at or near the middle of the bottom face. As a result, the bottom face, which must support the weight of the load in the box, is an openable face that is relatively weaker than the side faces and must be provided with a means for holding the bottom face closed, e.g., tape, adhesives, fasteners, etc.

In one embodiment, the blank components 14 and 16 each have at least one axis of symmetry. In the illustrated embodiment of FIG. 3, the blank components 14 and 16 each have two axes of symmetry. Advantageously, the symmetry enables the blanks 12 to be produced with very little waste, e.g., only the notches 36 and corners of the blank component 14 adjacent to the flaps 26 need to be removed from a rectangular sheet of material.

In the embodiment shown in FIG. 3, the panel 22 includes a feature 38 or features 40 (represented by dotted lines) which are in one embodiment perforations, scoring, cuts, grooves, slits, etc. The features 38 and/or 40 enable the panel 22, during or after construction of the case 10, to be easily separated into at least two pieces, e.g., to form a pair of flaps 42 from the panel 22 (best seen in FIG. 2, in which the case 10 is opened). For example, the panel 22 could be separated into the flaps 42 during an initial opening of the case 10 or during construction of the case 10, e.g., before case 10 is fully closed via the flaps 26. By aligning the panel 22 parallel to the openable face 28, the case 10 retains five unopenable faces even if the panel 22 is separated into the flaps 42 or multiple other pieces. In this way, the case 10 can be arranged to have four flaps (two of the flaps 26 and two of the flaps 42), and thus be a reclosable face. Namely, by reclosable it is meant that the face 28 can be reclosed, e.g., without adhesives or fasteners, by successively interlocking or interlacing the flaps by placing each flap over the next adjacent flap in a consistently clockwise or consistently counterclockwise manner, as is a well-known method of reclosure for RSCs. The feature 38 is located essentially at the mid-point of the panel 22 to promote full coverage of products contained in the case by the panel 22, while the features 42 result in shorter ones of the flaps 42, which may aid in the ability to perform the aforementioned interlocking reclosure method. It is to be appreciated that in one embodiment the panel 22 is positioned matingly against the panel 18, thereby being opposite, but still parallel, to the openable face 28, and not having to be separated in order to access items within the box.

As previously noted, a goal of the case 10 and other embodiments discussed herein is to provide the benefits of a bliss box or RSC as well as that of a wraparound box. As discussed above, the arrangement of the case 10 enables the case 10 to be reopened, reclosed, and/or reused (e.g., the case 10 is reclosable and/or exhibits reclosability). Advantageously, the blank 12 is also uniquely arranged to be wrapped directly about a load in order to manufacture the case 10 and close or seal the case 10 about a load simultaneously. In other words, the blank 12 is a wraparound blank and the case 10 is a wraparound container for its initial load.

Figure 5:
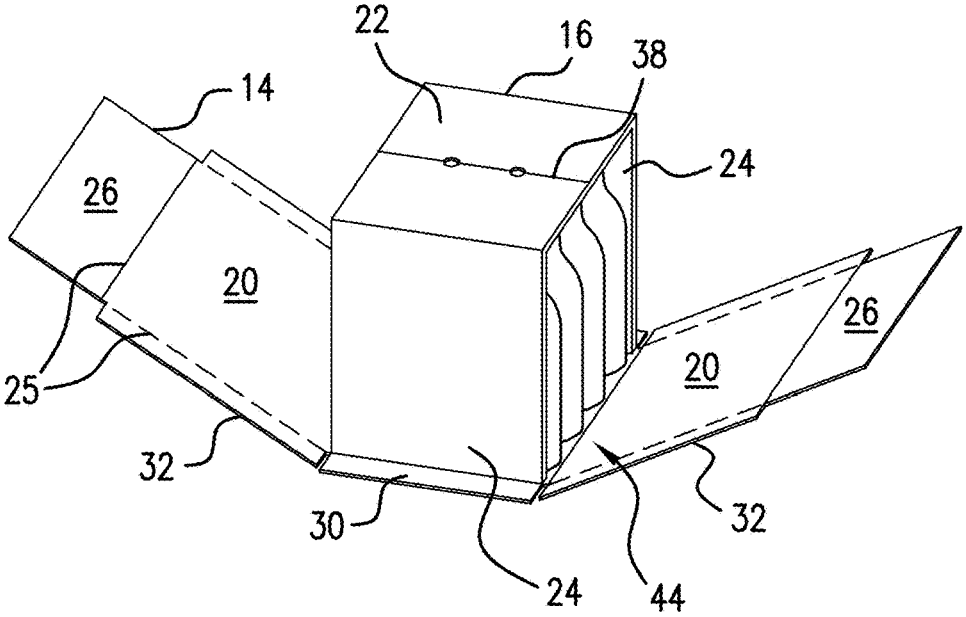
FIG. 5 is a perspective view of the blank of FIG. 3 being directly wrapped about a load.

A method of directly wrapping the blank 12 about a load 44 and closing or sealing the blank 12 about the load 44 to form the case 10 can be better appreciated in view of FIGS. 5 and 6. In the illustrated embodiment, the load 44 takes the form of bottles, although it is to be appreciated that any other products or items could be wrapped by the blank 12 in order to form the case 10. In one embodiment, the load 44 is a plurality of wine or spirit bottles. In the embodiment of FIGS. 4 and 5, the blank component 16 is placed with the panel 22 over the top of the load 44 and the panels 24 at two opposite sides of the load 44. Of course, it is again noted that the panels 22 and 24 could be arranged with respect to different directions or faces and that this is given as one example only. As shown in FIG. 5, the load 44, with the blank component 16, is placed a panel of the blank component 14, e.g., the panel 18 as shown. Alternatively, the load 44 could be stationary and the blank component 14 transferred or conveyed under the load 44. It is noted that the load 44 could first be arranged with the blank component 14, e.g., arranged on the panel 18, before the blank component 16 is folded about the load 44.

Regardless of the order of placement, once arranged as shown in FIG. 5, the portions of the blank component 14, e.g., the panels 20, flaps 26, and tabs 30 and 32 can be bent or folded, e.g., at the hinged connections 25, in order to surround the load 44 and enable the blank 12 to assume the shape of the case 10. If adhesives are used with the tabs 30 and 32, the adhesives can be applied to the blank 12, e.g., the tabs 30 and 32 or the corresponding surfaces of the panels 24, before the blank 12 is folded. Staples or other fasteners could be applied after folding. If the panel 22 is desired to be separated into the flaps 42, as discussed above the panel 22 can be cut or split, e.g., along the feature 38 and/or features 40, by a knife, blade, or other implement, before the case 10 is fully closed, e.g., by taping down the flaps 42.

It is to be recognized that the case 10 and other cases according to the embodiments discussed herein provide a wrap-around case that exhibits reclosability, e.g., is reusable. These cases have very little waste, and can be manufactured at higher rates than RSCs, bliss boxes, or other reusable boxes. For example, the automated manufacture and loading of RSC boxes is currently limited to a speed of less than about seventy five boxes per minute, while wrap-around cases, including the cases discussed herein, are able to be manufactured and fully loaded at rates exceeding seventy five cases per minute. Other benefits of the cases disclosed herein include that the panel opposite from the openable face, e.g., the bottom panel, is flat and includes no steps, as would be present in traditional RSCs (a filler sheet typically is required to give an RSC an internally flat bottom). The addition of the panel 22 along with the flaps 26 and the opposing panel 18 results in there being three layers of material in the stacking direction, as opposed to traditional wrap-arounds that only have two layers, thereby providing enhanced protection of packed items when multiple cases are stacked atop each other. When directly wrapped around a load, the dimensions of the blank 12 can be set to closely match those of the load in order to tightly contain the load within the case. In this way, the cases discussed herein do not require internal dividers between individual items or products, even if the products or items are fragile, e.g., glass bottles.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A wraparound case comprising:

a first blank component having no more than three panels defining a closure panel including a first side section, a second, opposing side section, a first edge and a second edge, a first side panel extending from the first side section and a second side panel extending from the first side section, the closure panel including a feature extending between the first and second edges, the closure panel being selectively separable at the feature; and a second blank component including a base panel portion having a first side portion, an opposing second side portion, a first edge portion and a second edge portion, a third side panel extending from the first side portion, a fourth side panel extending from the second side portion, a first flap extending from the third side panel and a second flap extending from the fourth side panel, the first blank component and the second blank component being directly wrapable about a load with the third side panel being joinable to the first and second side panels and the first edge of the closure panel and the fourth side panel being joinable to the first and second side panels and the second edge of the closure panel, the first flap, the second flap and the closure panel forming exactly one reclosable face of the wraparound case.

2. The wraparound case according to claim 1, wherein the base panel portion includes at least two tabs, one of the at least two tabs being joinable to the first side panel and another of the at least two tabs being joinable to the second side panel.

3. The wraparound case according to claim 1, wherein the third side panel includes at least two tabs, the third side panel being joinable to the first side panel through one of the at least two tabs and to the second side panel through another of the at least two tabs.

4. The wraparound case according to claim 1, wherein the first side section is defined by a hinged connection joining the closure panel with the first side panel and the second, opposing side section is defined by a hinged connection joining the closure panel and the second side panel.

5. The wraparound case according to claim 1, wherein the feature comprises one of perforations, a score line, a cut, a groove, and a slit.

6. The wraparound case according to claim 5, wherein the closure panel is separable into a third flap at the feature, the third flap forming at least a portion of the exactly one reclosable face.

7. The wraparound case according to claim 5, wherein the closure panel is separable into a third flap and a fourth flap at the feature, the third flap and the fourth flaps cooperating with the first and second flaps to form the exactly one reclosable face.

8. The wraparound case according to claim 7, wherein the exactly one reclosable face is reclosable by interlocking the first, second, third, and fourth flaps.

9. The wraparound case according to claim 1, wherein the first side panel is substantially parallel to the second side panel when the wraparound case is formed about a load.

10. The wraparound case according to claim 9, wherein the closure panel is substantially parallel to the base panel when the wraparound case is formed.

11. The wraparound case according to claim 1, wherein the exactly one reclosable face is reclosable without requiring one of an adhesive and a fastener.

* * * * *